US009890000B2

(12) United States Patent
Sugiyama et al.

(10) Patent No.: US 9,890,000 B2
(45) Date of Patent: Feb. 13, 2018

(54) SHEET CONVEYANCE APPARATUS AND IMAGE RECORDING APPARATUS

(71) Applicant: BROTHER KOGYO KABUSHIKI KAISHA, Nagoya-shi, Aichi-ken (JP)

(72) Inventors: Wataru Sugiyama, Nishio (JP); Yuta Uchino, Nagoya (JP); Ryuji Yamamoto, Handa (JP)

(73) Assignee: BROTHER KOGYO KABUSHIKI KAISHA, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/501,853

(22) Filed: Sep. 30, 2014

(65) Prior Publication Data

US 2015/0158686 A1 Jun. 11, 2015

(30) Foreign Application Priority Data

Dec. 6, 2013 (JP) ..... 2013-253395
Dec. 6, 2013 (JP) ..... 2013-253396

(51) Int. Cl.
*B65H 1/00* (2006.01)
*B65H 3/06* (2006.01)
(Continued)

(52) U.S. Cl.
CPC ..... *B65H 3/0684* (2013.01); *B65H 1/02* (2013.01); *B65H 3/0661* (2013.01); *B65H 3/44* (2013.01);
(Continued)

(58) Field of Classification Search
CPC .. B65H 1/02; B65H 1/027; B65H 2405/1117; B65H 3/0684; B65H 3/0661; B65H 3/44;
(Continued)

(56) References Cited

U.S. PATENT DOCUMENTS 6,158,733 A * 12/2000 Muraki ..... 271/127
7,080,833 B2 * 7/2006 Mitsuhashi ..... 271/162
(Continued)

FOREIGN PATENT DOCUMENTS

JP 3-92645 U1 9/1991
JP H05-278868 A 10/1993
(Continued)

OTHER PUBLICATIONS

Notice of Reasons for Rejection from corresponding Japanese Patent Application No. 2013-253395, dated Dec. 13, 2016.
Notice of Reasons for Rejection from corresponding Japanese Patent Application No. 2013-253396, dated Dec. 13, 2016.

*Primary Examiner* — Thomas Morrison
(74) *Attorney, Agent, or Firm* — Merchant & Gould P.C.

(57) ABSTRACT

There is provided a sheet conveyance apparatus, including: a casing; a sheet support unit including a first surface inclined to a placement surface; a separation unit arranged in the sheet support unit on a side of the placement surface and abutting against edges of the sheets supported by the first surface; a first plate member including a second surface arranged in the sheet support unit on a side opposite to the separation unit and faces in the same direction as the first surface; and a feed unit which feeds the sheet supported by the first surface and the distal end of the second surface to the conveyance path while slidably moving the sheet with respect to the separation unit.

10 Claims, 13 Drawing Sheets

(51) Int. Cl.

| | |
|---|---|
| ***B65H 1/02*** | (2006.01) |
| ***B65H 3/44*** | (2006.01) |
| ***B65H 3/56*** | (2006.01) |

(52) U.S. Cl.

CPC ..... *B65H 3/56* (2013.01); *B65H 2402/46* (2013.01); *B65H 2404/6111* (2013.01); *B65H 2405/1136* (2013.01); *B65H 2405/211* (2013.01); *B65H 2405/212* (2013.01); *B65H 2405/324* (2013.01)

(58) Field of Classification Search

CPC ..... B65H 3/56; B65H 2402/46; B65H 2404/6111; B65H 2405/1136; B65H 2405/211; B65H 2405/212; B65H 2405/324

USPC ..... 271/9.01, 9.09, 162, 121, 122

See application file for complete search history.

(56) References Cited

U.S. PATENT DOCUMENTS

| | | | | |
|---|---|---|---|---|
| 7,618,038 | B2 * | 11/2009 | Aida | B65H 1/04 271/145 |
| 8,072,653 | B2 * | 12/2011 | Iwata et al. | 358/474 |
| 2002/0060403 | A1 * | 5/2002 | Matsukawa | 271/162 |
| 2005/0062217 | A1 * | 3/2005 | Asada | B65H 3/0669 271/162 |
| 2007/0222136 | A1 * | 9/2007 | Murakami | 271/9.09 |
| 2013/0049289 | A1 * | 2/2013 | Ichikawa | 271/121 |
| 2013/0056924 | A1 * | 3/2013 | Mizuno et al. | 271/162 |

FOREIGN PATENT DOCUMENTS

| | | | |
|---|---|---|---|
| JP | 10-310274 | A | 11/1998 |
| JP | 2005-60026 | A | 3/2005 |
| JP | 2012-176853 | * | 9/2012 |
| JP | 2003-327332 | A | 11/2013 |

* cited by examiner

SHEET CONVEYANCE APPARATUS AND IMAGE RECORDING APPARATUS

CROSS REFERENCE TO RELATED APPLICATION

The present application claims priorities from Japanese Patent Application Nos. 2013-253395 and 2013-253396 both filed on Dec. 6, 2013, the disclosures of which are incorporated herein by reference in its entirety.

BACKGROUND

Field of the Invention

The present teaching relates to a sheet conveyance apparatus in which a sheet is fed from a sheet support unit via a conveyance path and an image recording apparatus including the sheet conveyance apparatus.

Description of the Related Art

There are known image recording apparatuses in which an image is recorded on a sheet conveyed via a conveyance path provided in a casing or housing body of the apparatus. Some of the image recording apparatuses include a sheet support unit supporting a plurality of sheets. An exemplary sheet support unit includes a support surface inclined to the direction of gravitational force, and guides a sheet obliquely downward toward the direction of gravitational force. Each sheet fed from the sheet support unit is separated from the sheets supported by the sheet support unit by use of a separation unit provided below the support surface, and then allowed to enter the conveyance path.

The sheets in various sizes such as A4 and A3 in accordance with Japanese Industrial Standards (JIS) can be used in the image recording apparatuses. In recent years, in addition to A4 sheet often used as office supplies in Japan, A3 sheet larger than A4 sheet is also used very often. Therefore, in order to extend the support surface of the sheet support unit, an extension tray is provided in some cases.

SUMMARY

In a structure in which a sheet is supported by a support surface of the extension tray in cooperation with the support surface of the sheet support unit, the support surface of the extension tray being a member independent from a member constituting the support surface of the sheet support unit, the extension tray may be rotatably provided in the sheet support unit. For example, in a structure in which the sheet support unit is formed of a plurality of members which are rotatable with each other, depending on the rotation state of each of the members, it may be structurally difficult to position the support surface of the extension tray and the support surface of the sheet support unit so that they are included in the same virtual plane. Or, depending on the rotation state of each of the members, it may be structurally difficult to arrange the support surface of the extension tray and the support surface of the sheet support unit so that they are at least parallel to each other in a case that there is a small difference in height between these support surfaces. Therefore, when the extension tray is rotatably provided in the sheet support unit by a simple structure without considering the possible problems about the arrangement, the support surface of the sheet support unit and the support surface of the extension tray may not be included in the same virtual plane or may not be parallel to each other. As a result, the sheet supported by the support surface of the sheet support unit and the support surface of the extension tray is bent or curved. Depending on the direction of bend or curve of the sheet, there is fear that the separation performance of the separation unit is reduced.

The present teaching has been made to solve the foregoing problems, an object of which is to provide a means capable of extending a support surface of a sheet support unit by the aid of a support surface of another member and capable of preventing the deterioration of sheet separation performance, or an object of which is to provide a means capable of supplementing the support surface of the sheet support unit with another member and capable of preventing the deterioration of sheet separation performance.

According to an aspect of the present teaching, there is provided a sheet conveyance apparatus configured to convey a sheet, including:

a casing including a conveyance path defined therein;

a sheet support unit including a first surface inclined to a placement surface on which the casing is placed and configured to support a plurality of sheets stacked thereon;

a separation unit arranged in the sheet support unit on a side of the placement surface and configured to abut against edges of the sheets supported by the first surface;

a first plate member including a second surface which is arranged in the sheet support unit on a side opposite to the separation unit and faces in the same direction as the first surface, wherein a proximal end of the second surface close to the first surface is positioned on a side nearer to the placement surface than a virtual plane including the first surface, and a distal end of the second surface far from the first surface is movable between a first position where the distal end is positioned on the virtual plane and a second position where the distal end is in a position different from the virtual plane; and a feed unit configured to feed the sheet supported by the first surface and the distal end of the second surface to the conveyance path while slidably moving the sheet with respect to the separation unit.

Since the first surface of the sheet support unit and the distal end of the second surface of the first plate member in the first position are included in the same virtual plane, the sheet supported by the first surface and the distal end of the second surface is neither bent nor curved. Further, when the first plate member is in the first position, a third surface of a second plate member in a fourth position is parallel to the virtual plane. Thus, a surface of the sheet is not bent at a boundary between the distal end of the second surface and the third surface.

According to the present teaching, the first surface of the sheet support unit can be extended by the aid of the second surface of the first plate member and the third surface of the second plate member, and it is possible to prevent the deterioration of sheet separation performance of the separation unit.

DESCRIPTION OF THE EMBODIMENTS

Figure 1:
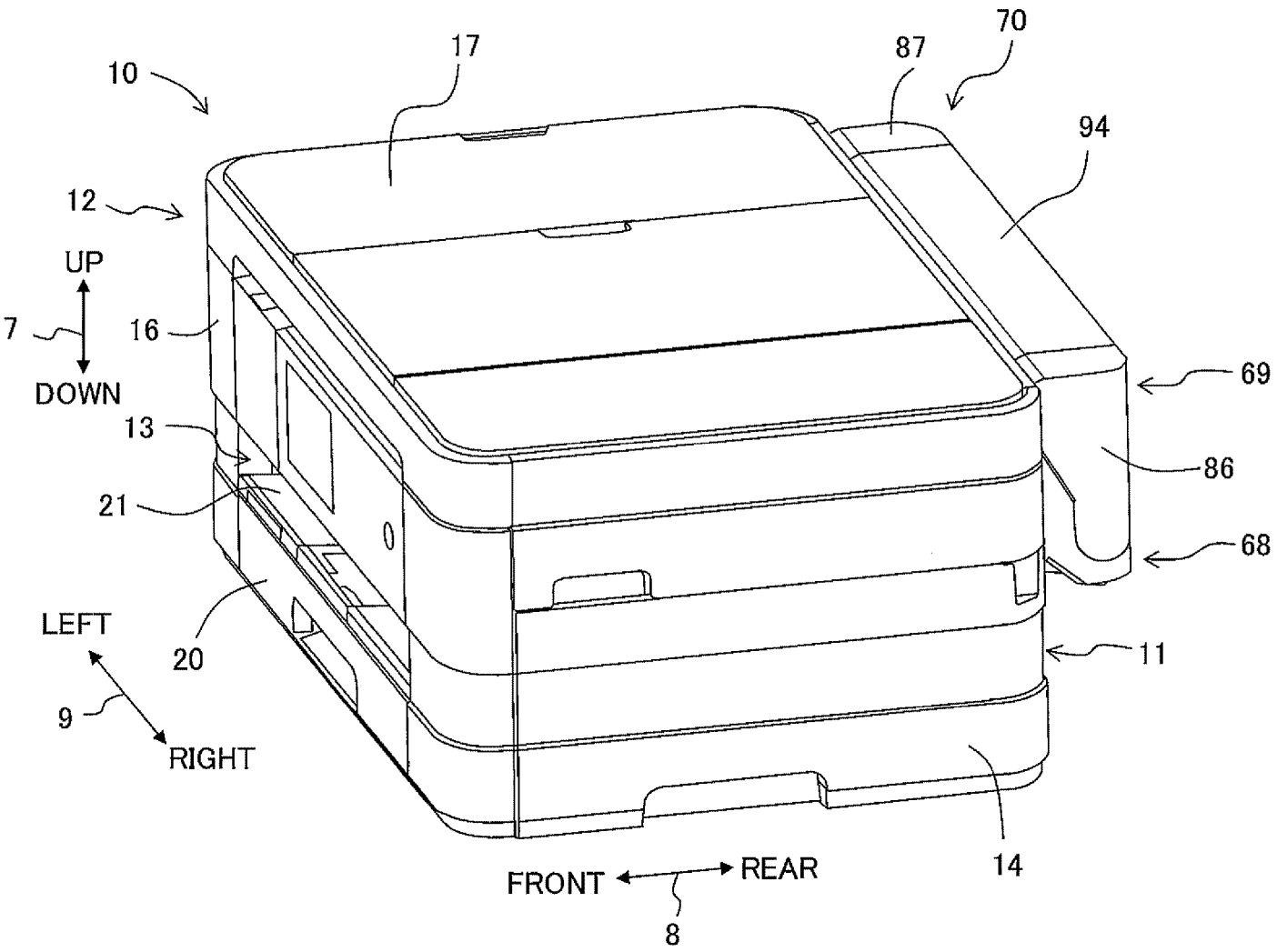
FIG. 1 is a perspective external view of a multi-function peripheral 10 in which a movable unit 69 is in an upstanding state.

An explanation will be made below about a multi-function peripheral 10 according to an embodiment of the present teaching. It goes without saying that the embodiment explained below is merely an example of the present teaching, and the embodiment can be appropriately changed within a range without changing the gist or essential characteristics of the present teaching. Further, in the following explanation, the up-down direction 7 of the multi-function peripheral 10 is defined on the basis of the state (state depicted in FIG. 1) in which the multi-function peripheral 10 (an exemplary image recording apparatus of the present teaching) is placed to be usable, the front-rear direction 8 of the multi-function peripheral 10 is defined assuming that the side, on which an opening 13 is provided, is the near side (front side), and the left-right direction 9 of the multi-function peripheral 10 is defined while viewing the multi-function peripheral 10 from the near side (front side).

<Entire Structure of Multi-Function Peripheral 10>

As depicted in FIG. 1, the multi-function peripheral 10 is formed to have approximately cuboid form, and the multi-function peripheral 10 is provided with a printer unit 11 for recording an image on a sheet such as the recording sheet S in accordance with the ink jet recording system. The multi-function peripheral 10 has various functions including, for example, the facsimile function and the printing function. The printer unit 11 corresponds to the image recording apparatus of the present teaching.

The printer unit 11 has a casing or housing body 14 which has an opening 13 formed on its front surface. A feed tray 20 and a discharge tray 21, which are capable of accommodating the recording sheet S of various sizes, can be inserted into and withdrawn from the casing 14 via the opening 13 in the front-rear direction 8. The bottom surface of the casing 14 abuts against the placement surface on which the multi-function peripheral 10 is placed.

Figure 2:
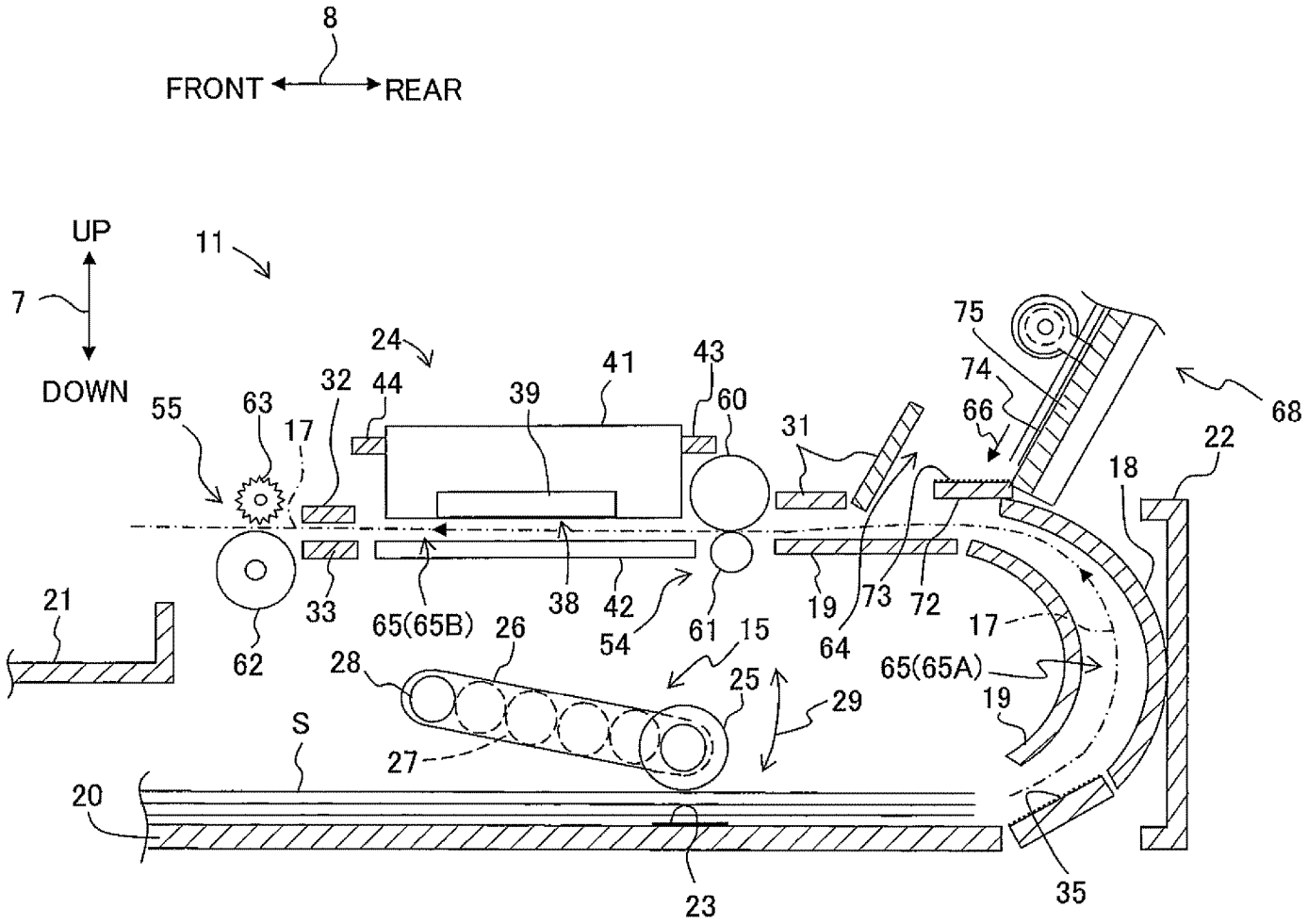
FIG. 2 is a vertical cross-sectional view of an internal structure of a printer unit 11.

As depicted in FIG. 2, the printer unit 11 is provided with, for example, a feed unit 15 for feeding the recording sheet S from the feed tray 20, a recording unit 24 for recording the image on the recording sheet S, a first conveyance roller pair 54, a second conveyance roller pair 55 and the like.

As depicted in FIG. 1, a scanner unit 12 is provided above the printer unit 11. A casing 16 of the scanner unit 12 has the sizes in the front-rear direction 8 and the left-right direction 9 which are the same as those of the casing 14 of the printer unit 11. Therefore, the casing 14 of the printer unit 11 and the casing 16 of the scanner unit 12 are integrated into one unit to form an outer shape of the multi-function peripheral 10 having the approximately cuboid form. The scanner unit 12 is a flatbed scanner. The structure of the flatbed scanner is known, any detailed explanation of which is omitted herein. Further, the scanner unit 12 may be provided with an automatic document feeder (ADF) for picking up a plurality of sheets of manuscript or document one by one and conveying each of the sheets.

<Printer Unit 11>

The structure of the printer unit 11 will be explained in detail below. The printer unit 11 corresponds to the image recording apparatus of the present teaching. Further, a mechanism which conveys a sheet such as the recording sheet in the printer unit 11 corresponds to a sheet conveyance apparatus of the present teaching.

<Feed Tray 20>

The feed tray 20 has such an outer shape that the lengths in the front-rear direction 8 and the left-right direction 9 are longer than the length in the up-down direction 7, and the feed tray 20 has a box-shaped form of which upper side is open. The discharge tray 21 is provided on the front side of the upper surface of the feed tray 20. The feed tray 20 can accommodate the recording sheet S by supporting, on the support surface, the recording sheet S having various sizes including, for example, the A4 size based on the Japanese Industrial Standards and the L size used for the photograph recording. The feed tray 20 is installed detachably to the internal space communicated with the opening 13 of the casing 14. The feed tray 20 is movable back and forth in the front-rear direction 8 with respect to the casing 14 via the opening 13.

<Feed Unit 15>

As depicted in FIG. 2, the feed unit 15 is provided with a feed roller 25, a feed arm 26, a driving transmission mechanism 27 and a separation pad 23. The feed unit 15 is provided over or above the feed tray 20 and under or below the recording unit 24. The feed roller 25 is rotatably supported at a forward end portion of the feed arm 26. The feed arm 26 is swingable in the direction of the arrow 29 with a rotational shaft 28 provided at a proximal end portion as the center of swing. Accordingly, the feed roller 25 can make the abutment and the separation with respect to the support surface of the feed tray 20. Therefore, when the feed tray 20 is installed in the casing 14 while accommodating the recording sheet S, the feed roller 25 can abut against the recording sheet S accommodated in the feed tray 20. The separation pad 23 is provided at the position at which the feed roller 25 abuts against the support surface of the feed tray 20 when the feed tray 20, which accommodates no recording sheet S, is installed in the casing 14. The separation pad 23 is formed of a material having a frictional coefficient with respect to the recording sheet S which is larger than a frictional coefficient with respect to the recording sheet S of the support surface of the feed tray 20.

The driving force of a motor (not depicted) is transmitted to the feed roller 25 via the driving transmission mechanism 27. The driving transmission mechanism 27 transmits the rotation transmitted to the rotational shaft 28 to the shaft of the feed roller 25 by means of a gear array including a plurality of gears. When the feed roller 25 is rotated in a state in which the feed roller 25 abuts against the recording sheet S disposed on the uppermost side of the recording sheets S supported on the support surface of the feed tray 20, the uppermost recording sheet S is thereby fed toward a conveyance path 65. When the recording sheet S is fed toward the conveyance path 65, the forward end of the recording sheet S abuts against a separation member 35 provided on the back side in the front-rear direction 8 of the feed tray 20. As a result, only the recording sheet S, which is disposed on the uppermost side, is conveyed while being separated from the recording sheets S which are disposed on the lower side. The recording sheets S, which are disposed on the lower side of the recording sheets S disposed at the uppermost side, are retained in the feed tray 20 without being dragged by the recording sheet S which is disposed on the uppermost side.

<Conveyance Path 65>

As depicted in FIG. 2, the conveyance path 65, which is provided in the internal space of the casing 14, extends while being curved to make a U-turn upwardly from the back side of the feed tray 20. Further, the conveyance path 65 is bent frontwardly from the back side of the printer unit 11. After that, the conveyance path 65 further extends substantially in a straight line toward the front side of the printer 11 to arrive at the discharge tray 21. The conveyance path 65 is roughly classified into a curved passage 65A which makes the U-turn and a straight passage 65B which is straight.

The curved passage 65A is defined by an outer guide member 18, an inner guide member 19 and a guide member 31. Spaces through which the recording sheet S can pass are respectively defined between the outer guide member 18 and the inner guide member 19 and between the outer guide member 18 and the guide member 31. The straight passage 65B is defined by the recording unit 24, a platen 42, a guide member 32 and a guide member 33. The recording unit 24 and the platen 42 are opposed to each other while being separated by the space through which the recording sheet S can pass, and the guide member 32 and the guide member 33 are opposed to each other while being separated by the space through which the recording sheet S can pass.

The recording sheet S, which is fed to the conveyance path 65 by the feed roller 25 of the feed tray 20, is conveyed along the curved passage 65A from the lower side to the upper side. In this procedure, the conveyance direction 17 is reversed from the backward direction to the forward direction. After that, the recording sheet S is conveyed from the back side to the front side without reversing the conveyance direction 17 through the straight passage 65B.

The outer guide member 18 constitutes the outer guide surface of the curved passage 65A when the recording sheet S is conveyed via the curved passage 65A. The inner guide member 19 constitutes the inner guide surface of the curved passage 65A when the recording sheet S is conveyed via the curved passage 65A. Each of the guide surfaces may be constructed by one surface, or each of the guide surfaces may be constructed as an enveloping surface of forward ends of a plurality of ribs.

The guide member 31 is arranged over or above the inner guide member 19 just upstream from (on the back side of) the first conveyance roller pair 59. The outer guide member 18 and the guide member 31 also define a bypass route 66 described later on.

<Back Surface Cover 22>

As depicted in FIG. 2, the back surface cover 22 constructs a part of the back surface of the casing 14 while supporting the outer guide member 18. The back surface cover 22 is swingably supported with respect to the casing 14 at its both right and left ends on the lower side. When the back surface cover 22 is swung so that its upper side is allowed to incline backwardly about the rotational shaft provided in the left-right direction 9 on the lower side, a part of the conveyance path 65 and a part of the bypass route 66 described later on are thereby released (exposed) to the outside of the casing 14.

The outer guide member 18 is also swingably supported with respect to the casing 14 at the both left and right ends on the lower side in the same manner as the back surface cover 22. The outer guide member 18 is also swingable so that the upper side thereof is allowed to incline backwardly about the rotational shaft in the left-right direction 9 on the lower side in a state in which the back surface cover 22 is swung so that the back surface cover 22 is allowed to incline backwardly. When the outer guide member 18 is swung so that the outer guide member 18 is allowed to incline backwardly, at least a part of the curved passage 65A is thereby released (exposed). As depicted in FIG. 2, when the back surface cover 22 is closed to provide the upstanding state, then the outer guide member 18 is maintained in the upstanding state while being supported by the back surface cover 22 from the back, and the outer guide member 18 is opposed to the inner guide member 19 to define a part of the curved passage 65A.

<First Conveyance Roller Pair 54 and Second Conveyance Roller Pair 55>

As depicted in FIG. 2, the first conveyance roller pair 54 is provided on the upstream side of the recording unit 24 in the conveyance direction 17 of the recording sheet S along the conveyance path 65. The first conveyance roller pair 54 has a first conveyance roller 60 and a pinch roller 61. Similarly, the second conveyance roller pair 55 is provided on the downstream side of the recording unit 24 in the conveyance direction 17. The second conveyance roller pair 55 has a second conveyance roller 62 and a spur roller 63. The first conveyance roller 60 and the second conveyance roller 62 are rotated by transmitting the rotation of the motor (not depicted). When the first conveyance roller 60 and the second conveyance roller 62 are rotated in a state in which the recording sheet S is interposed between the respective rollers for constructing the first conveyance roller pair 59 and the second conveyance roller pair 55 respectively, the first conveyance roller pair 54 and the second conveyance roller pair 55 thereby transport the recording sheet S in the conveyance direction 17 along the conveyance path 65.

<Recording Unit 24>

As depicted in FIG. 2, the recording unit 24 is provided between the first conveyance roller pair 54 and the second conveyance roller pair 55. The recording unit 24 is provided with a carriage 41 and a recording head 39. The carriage 41 is supported by guide rails 43, 44 provided on the back side and the front side of the platen 42 so that the carriage 41 is reciprocatively movable in the left-right direction 9. A known belt mechanism is provided for the guide rail 44. The carriage 41 is coupled to an endless belt of the belt mechanism. The carriage 41 is reciprocatively moved in the left-right direction 9 along the guide rails 43, 44 in accordance with the rotation of the endless belt. When the carriage 41 and the recording head 39 are opposed to the platen 42 with the space intervening therebetween, the carriage 41, the recording head 39 and the platen 42 define a part of the straight passage 65B.

The recording head 39 is carried on the carriage 41. A plurality of nozzles 38 are formed on the lower surface of the recording head 39. Inks are supplied from ink cartridges (not depicted) to the recording head 39. The recording head 39 selectively discharges the inks as minute ink droplets from the plurality of nozzles 38. The ink droplets are discharged to the recording sheet S supported by the platen 42 from the nozzles 38 when the carriage 41 is moved in the left-right direction 9. The discharged ink droplets adhere to the recording sheet S on the platen 42, and thus an image is recorded on the recording sheet S.

<Bypass Route 66>

As depicted in FIG. 2, the opening 64 is provided over or above the back surface cover 22 at the back surface of the casing 14. The bypass route 66, which extends from the opening 64 to the first conveyance roller pair 54, is formed in the casing 14. The bypass route 66 extends from the upper backward to the lower frontward in the casing 14. The bypass route 66 is defined, for example, by the guide member 31, the outer guide member 18 and the back surface cover 22. The guide member 31 constructs the guide surface on the upper side when the recording sheet S is conveyed via the bypass route 66. The outer guide member 18 and the back surface cover 22 construct the guide surface on the lower side when the recording sheet S is conveyed via the bypass route 66. Both of the curved passage 65A and the straight passage 65B of the conveyance path 65 are arranged under or below the bypass route 66. A part of the bypass route 66 is released (exposed) to the outside of the casing 14 together with a part of the conveyance path 65 in accordance with the swing of the outer guide member 18 and the back surface cover 22 so that their upper sides are allowed to incline backwardly.

The recording sheet S, which is accommodated in the bypass tray 70 described later on, is guided obliquely downwardly along the bypass route 66. The recording sheet S is guided along the straight passage 65B of the conveyance path 65, and the recording sheet S is conveyed by the first conveyance roller pair 54. Further, the image recording is performed on the recording sheet S by the recording unit 24, and the recording sheet S is discharged to the discharge tray 21. In this way, the recording sheets S, which are accommodated in the bypass tray 70, are each conveyed via the route having the substantially straight shape (route in which the front surface and the back surface of the recording sheet S are not reversed in the up-down direction 7).

<Bypass Tray 70>

Figure 3:
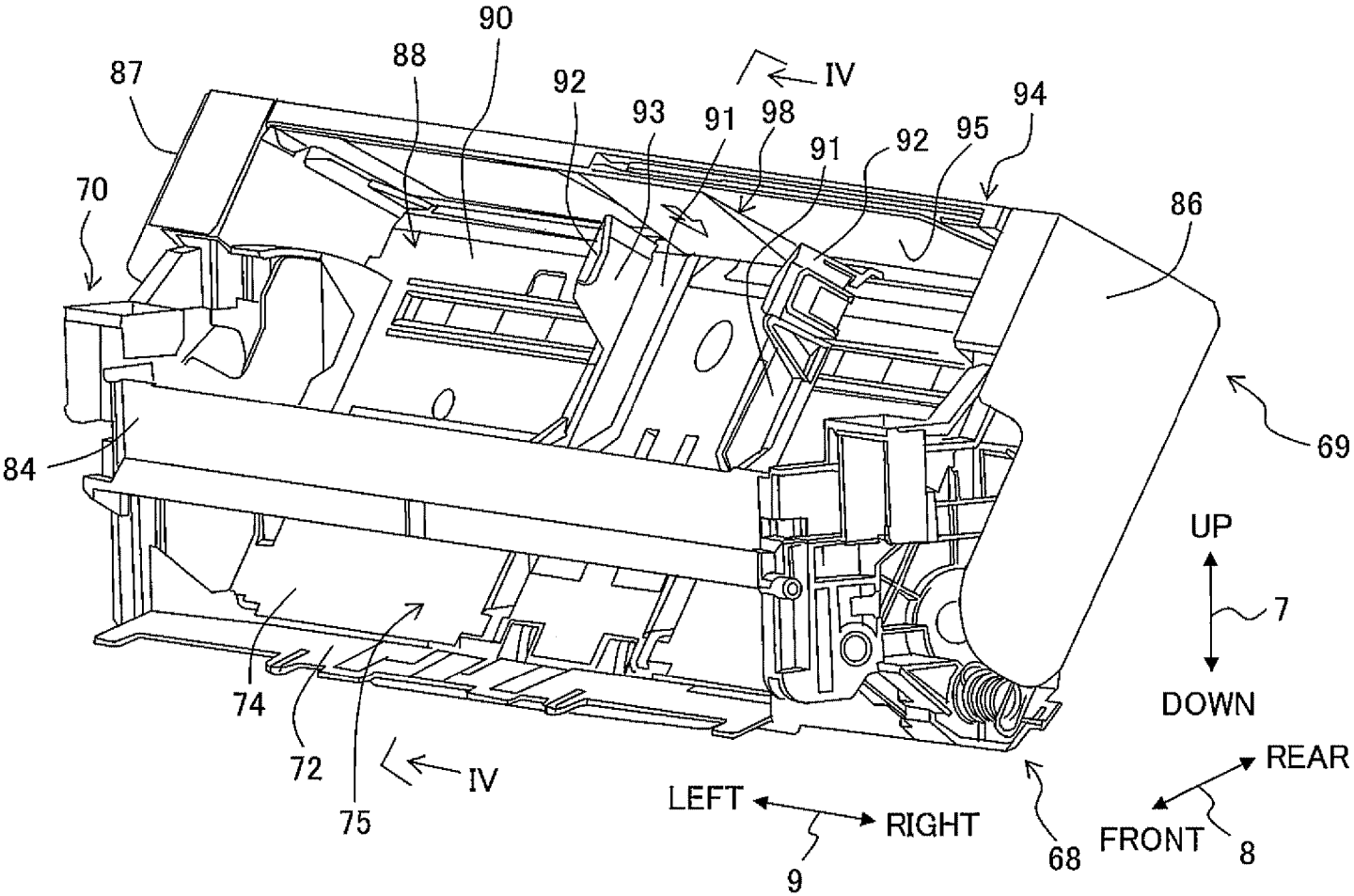
FIG. 3 is a perspective view of a bypass tray 70 in which the movable unit 69 is in an inclined or laid-down state and a tray cover 94 is in a sealing position.

As depicted in FIGS. 1 and 3, the bypass tray 70 is provided on the back surface side of the multi-function peripheral 10. The bypass tray 70 can load or accommodate the recording sheets independently from the feed tray 20. The bypass tray 70 corresponds to a sheet support unit.

Figure 5:
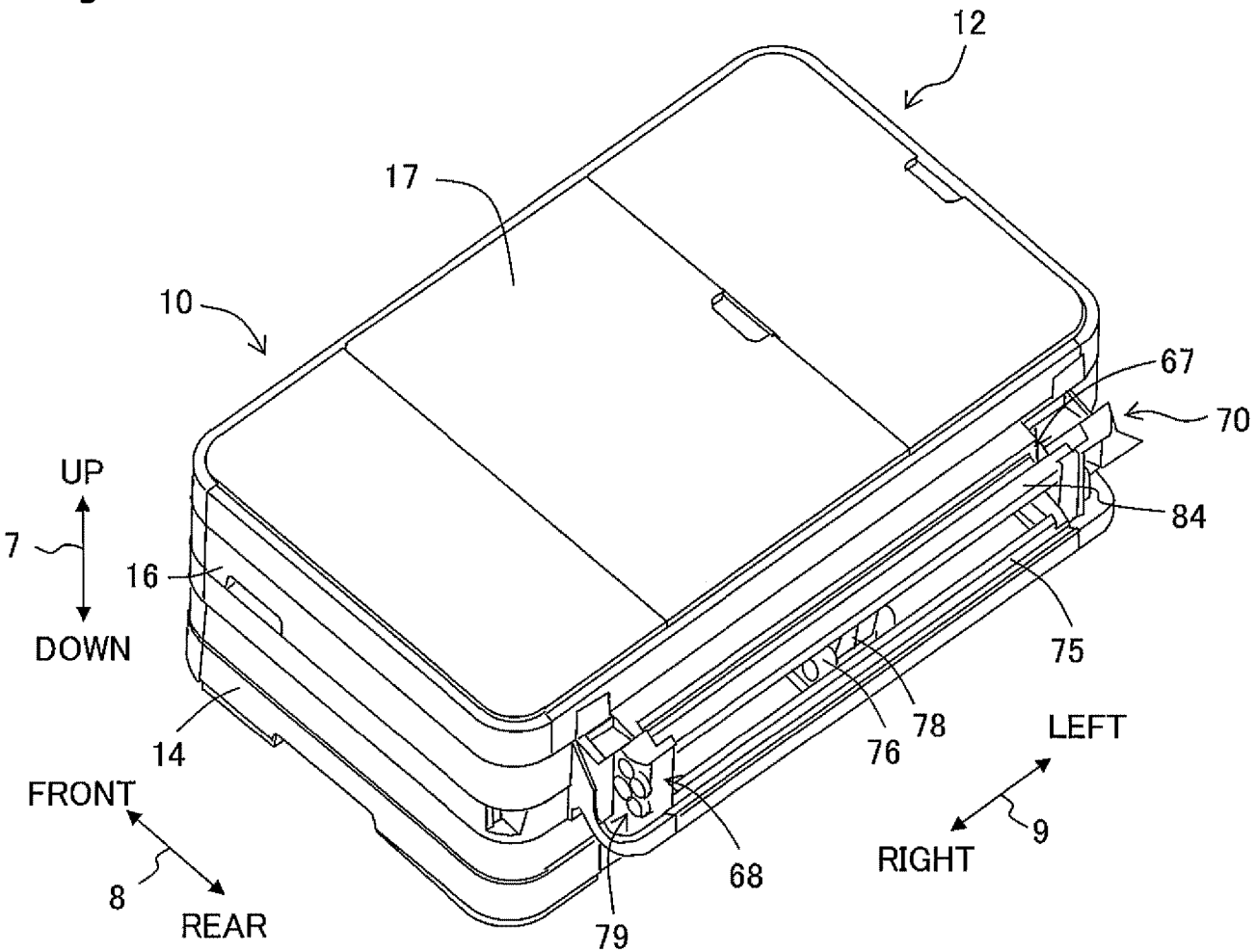
FIG. 5 is a perspective external view of the multi-function peripheral 10 on a back surface side in which the movable unit 69 is removed.

As depicted in FIGS. 1 and 5, a fixed unit 68, which extends downward to cover the opening 64 (see FIG. 2) therewith, is formed on the back surface side of the casing 16 of the scanner unit 12. The fixed unit 68 constitutes a part of the bypass tray 70 on the downstream side in the conveyance direction. As depicted in FIG. 3, a movable unit 69 is provided on the upper side of the fixed unit 68 so as to be rotatable with respect to the fixed unit 68. The bypass tray 70 is constructed by the fixed unit 68 and the movable unit 69.

As depicted in FIG. 5, a slit-shaped opening 67, which extends in the left-right direction 9, is formed on the upper surface of the fixed unit 68. In the bypass tray 70, a passage is formed via the opening 67 to arrive at the bypass route 66 (see FIG. 2). As depicted in FIG. 3, a support member 75 including a support surface 74 is provided in the fixed unit 68. The support surface 74 extends obliquely downward to the bypass route 66 (see FIG. 2). The lower end of the support member 75 forms a part of the guide surface which guides the recording sheet conveyed via the bypass route 66.

Figure 4:
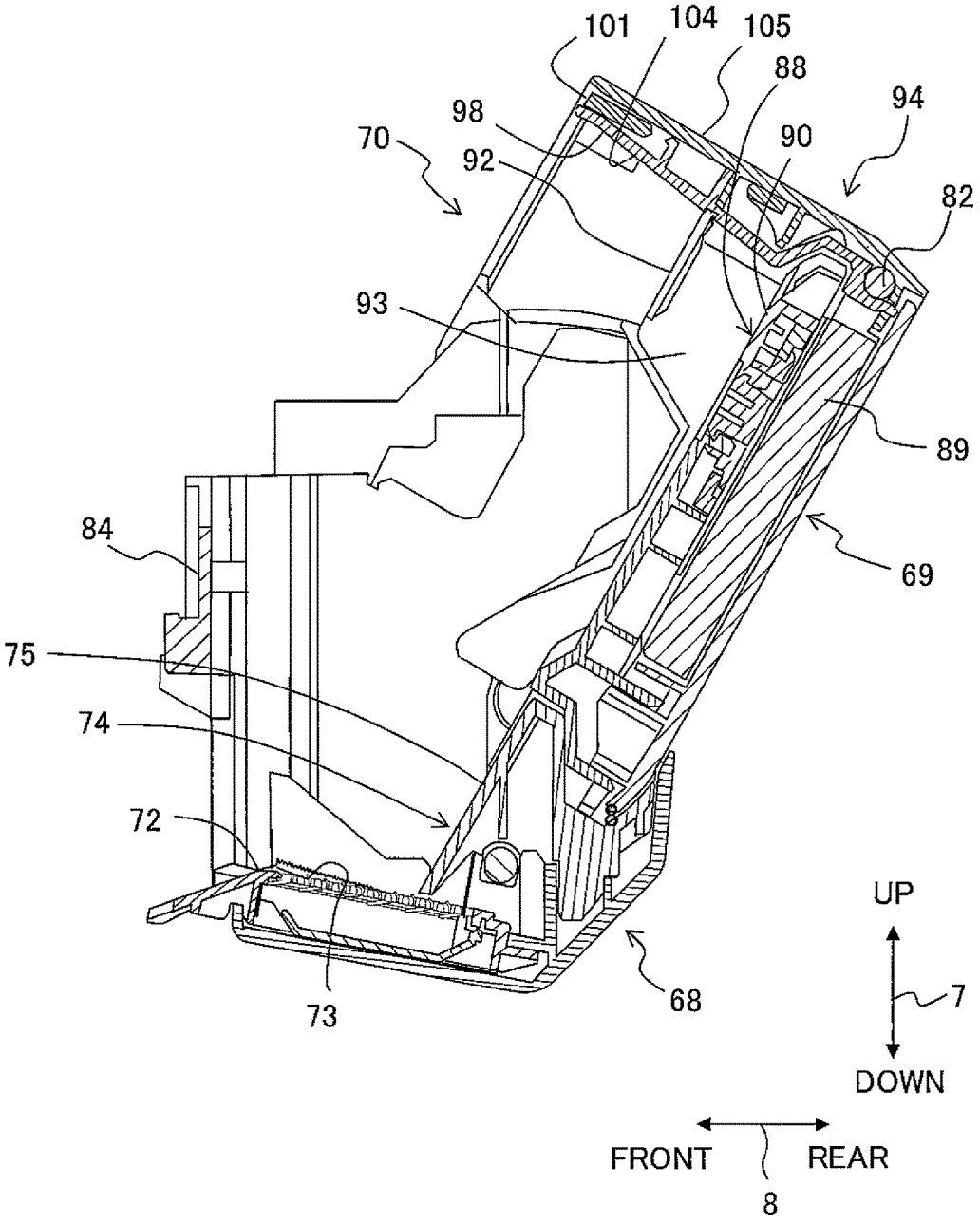
FIG. 4 is a cross-sectional view taken along the line IV-IV of FIG. 3.

As depicted in FIGS. 3 and 4, the separation piece 72 is provided below the support member 75 of the fixed unit 68. The separation piece 72 is positioned at a height which is substantially the same as that of the opening 64 in the up-down direction 7. The upper surface of the separation piece 72 is a surface against which the forward ends of the recording sheets supported by the bypass tray 70 abut. On the upper surface of the separation piece 72, a plurality of teeth 73 (see FIG. 4) are aligned in the front-rear direction 8 to project upward from the upper surface. The forward ends of recording sheets supported by the bypass tray 70 are disentangled or unraveled by the teeth 73. The separation piece 72 corresponds to a separation unit. In FIG. 3, the illustration of the teeth is omitted.

As depicted in FIG. 5, a reinforcing member 84, which rotatably supports an unillustrated driving shaft of the feed roller 76, is provided above the support surface 74 on the upper end side of the support member 75. The driving force is transmitted from an unillustrated motor to the driving shaft of the feed roller 76 supported by the reinforcing member 84 via a driving transmission unit 79, and thus the feed roller 76 is allowed to rotate.

As depicted in FIG. 5, the driving transmission unit 79, which is composed of a plurality of pinion gears, is provided on the right side of the fixed unit 68 in the left-right direction 9. The driving force is transmitted to the driving transmission unit 79 from the unillustrated motor provided in the casing 14 of the printer unit 11. The driving shaft of the feed roller 76 extends in the left-right direction 9, and one end thereof is meshed or engaged with the pinion gears constituting the driving transmission unit 79. The other end of the driving shaft extends to the center of the fixed unit 68 in the left-right direction 9.

The driving shaft of the feed roller 76 swingably supports an arm 78. That is, the arm 78 is swingably around the driving shaft of the feed roller 76. The feed roller 76 is rotatably supported by the arm 78 on the side of a rotation forward end. The arm 78 extends downward from the driving shaft of the feed roller 76 toward the support surface 74 of the support member 75. The arm 78 is arranged at the center of the fixed unit 68 in the left-right direction 9.

The feed roller 76 is connected to the driving shaft by an unillustrated endless belt. The rotation of the driving shaft is transmitted to the feed roller 76 via the endless belt to rotate the feed roller 76. The feed roller 76 is rotated in a state of being allowed to abut against the recording sheet disposed on the uppermost side of the recording sheets supported by the support surface 74 of the bypass tray 70, and thus the uppermost recording sheet is fed via the bypass route 66. The recording sheets, which are disposed on the lower side of the uppermost recording sheet, are disentangled or unraveled by the teeth 73 of the separation piece 72 and they are retained in the bypass tray 70 without being dragged by the recording sheet disposed on the uppermost side. In this way, a feed unit, which is constructed by the feed roller 76, the driving shaft and the arm 78 is arranged in a space above the support surface 74 at the outside of the casing 14.

As depicted in FIGS. 3 and 4, the movable unit 69 is provided on the upper side of the fixed unit 68 to be rotatable with respect to the fixed unit 68. The movable unit 69 is rotatable between the upstanding state in which the movable unit 69 upstands in the up-down direction 7 as depicted in FIG. 1 and the inclined or laid-down state in which the movable unit 69 is inclined with respect to the up-down direction 7 as depicted in FIG. 3. The upstanding state is a state for reducing the space which is occupied by the movable unit 69 on the back surface side of the casing 14. The bypass tray 70 is not used in a case that the movable unit 69 is in the upstanding state. The back surface of the movable unit 69 in the upstanding state is substantially parallel to the back surface of the casing 14. The inclined state is a state as follows. That is, the movable unit 69 is inclined obliquely upward toward the outside of the casing 14, so that inclined support surfaces 74, 90 are allowed to form substantially one flat surface. In this situation, the bypass tray 70 is available. Whether the movable unit 69 is allowed to be in the upstanding state or the inclined state can be arbitrarily selected in accordance with the operation of a user.

As depicted in FIG. 3, side walls 86, 87 are provided on both sides of the movable unit 69 in the left-right direction 9. The side walls 86, 87 cover parts of the both sides of the fixed unit 68 in the left-right direction 9. The driving transmission unit 79, which is provided on the right side of the fixed unit 68 in the left-right direction 9, is covered with the side wall 86 of the movable unit 69.

As depicted in FIG. 3, a support member 88 is provided to span the side walls 86, 87 of the movable unit 69. In the inclined state of the movable unit 69, a support surface 90 provided on the upper surface of the support member 88 and the support surface 74 form substantially the same flat surface. Thus, a surface formed by the support surface 74 and the support surface 90 supports the recording sheet in the bypass tray 70. In the upstanding state of the movable unit 69, the support surface 90 is perpendicular to the placement surface for the multi-function peripheral 10; in other words, the support surface 90 extends in the up-down direction 7 and the left-right direction 9. The support surface 90 corresponds to a first surface. In this embodiment, the placement surface on which the multi-function peripheral 10 is placed is a surface which expands in the left-right direction 9 and the front-rear direction 8. For example, the placement surface is a horizontal surface perpendicular to the vertical direction (the direction of gravitational force). Here, "substantially one flat surface (the same flat surface)" means a flat surface on which the supported recording sheet is neither bent nor flexed even when there is a small difference in height between two surfaces constituting the flat surface; in other words, it means a flat surface on which the recording sheet S is supported so that separation performance is stably obtained by the separation piece 72.

As depicted in FIG. 3, the support member 88 is provided with a pair of side guides 92. The side guides 92 are separated from each other in the left-right direction 9 to form a pair, and the side guides 92 protrude upward from the support surface 90. The side guide 92 includes a guide surface 93 which extends in the conveyance direction of the recording sheet S in the bypass tray 70. In a case that the recording sheet S on the support surface 90 is conveyed, the edge of the recording sheet in the conveyance direction is guided by the guide surface 93.

The side guide 92 has a support surface 91 along the support surface 90 of the support member 88. That is, the side guide 92 is L-shaped such that the guide surface 93 is perpendicular to the support surface 91. Although there is a small difference in height between the support surfaces 90, 91, the support surface 91 is substantially flush with the support surface 90. The support surface 91 supports the recording sheet with the support surfaces 74, 90. The distance, by which the side guides 92 are separated from each other in the left-right direction 9, is variable. Accordingly, the edges of the recording sheets having various sizes supported by the support surfaces 90, 91 can be guided by the guide surface 93 of the side guide 92.

Figure 7:
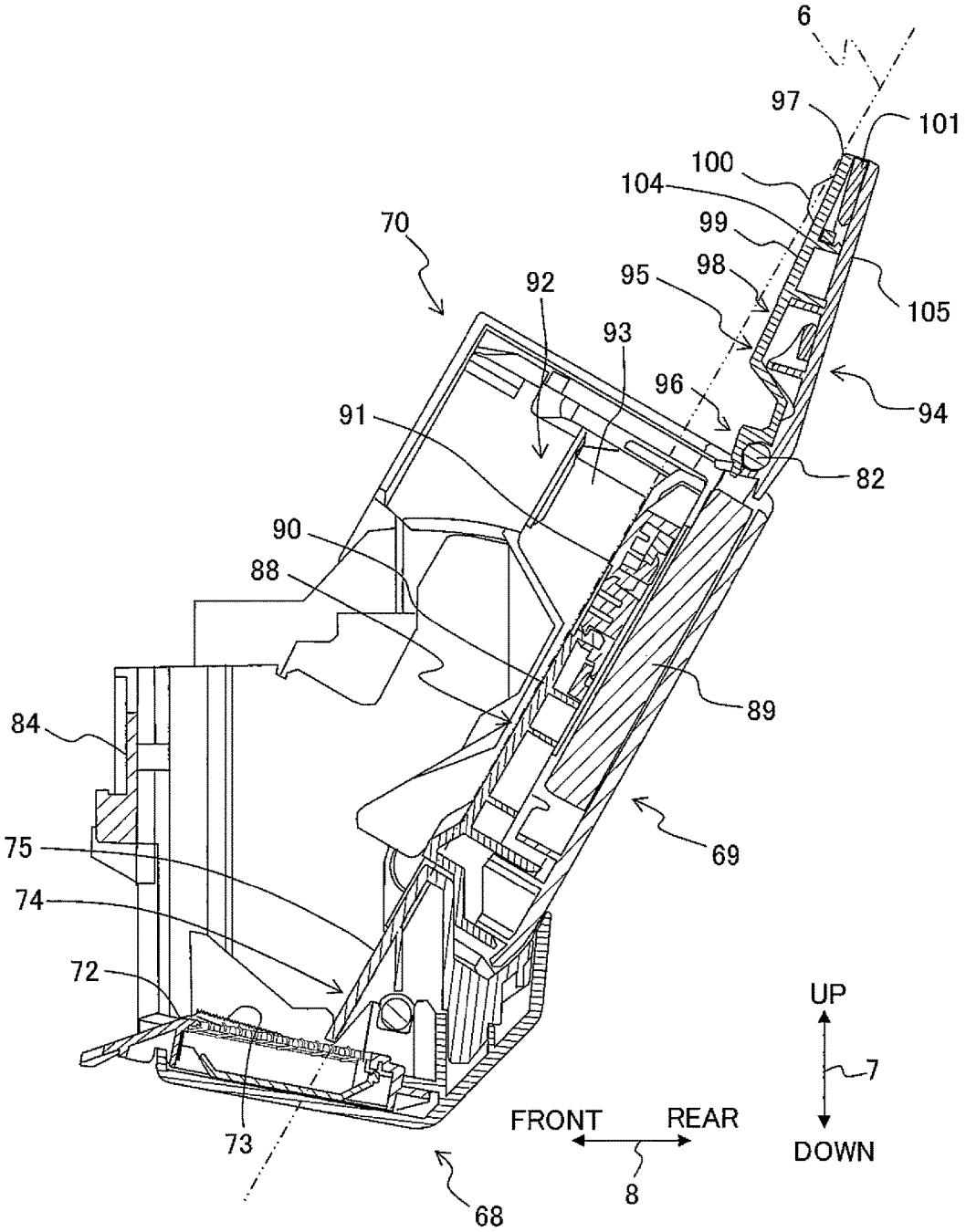
FIG. 7 is a cross-sectional view taken along the line VII-VII of FIG. 6.
Figure 8:
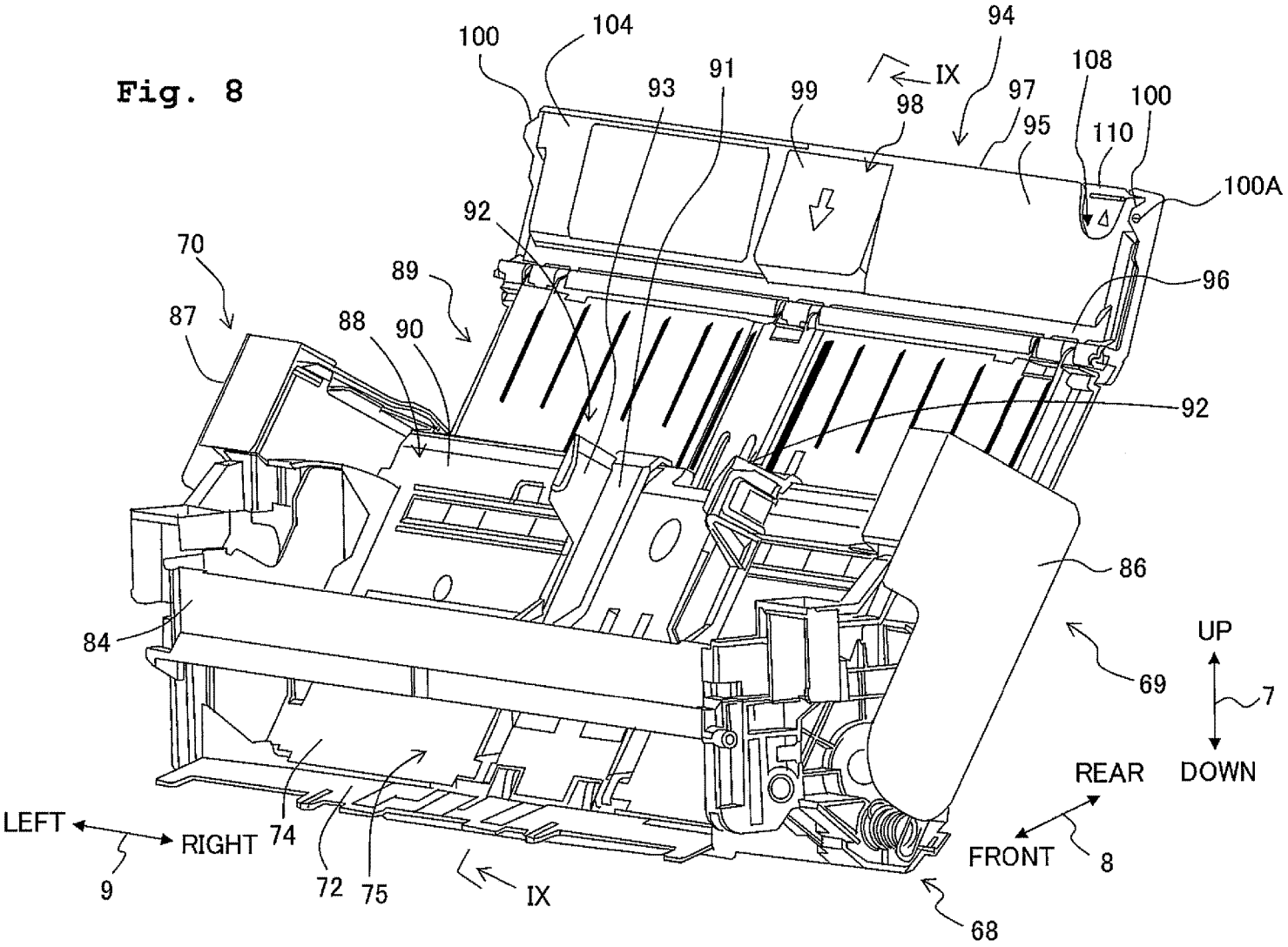
FIG. 8 is a perspective view of the bypass tray 70 in which the movable unit 69 is in the inclined state, an extension member 89 is extended, and the tray cover 94 is in the open position.
Figure 9:
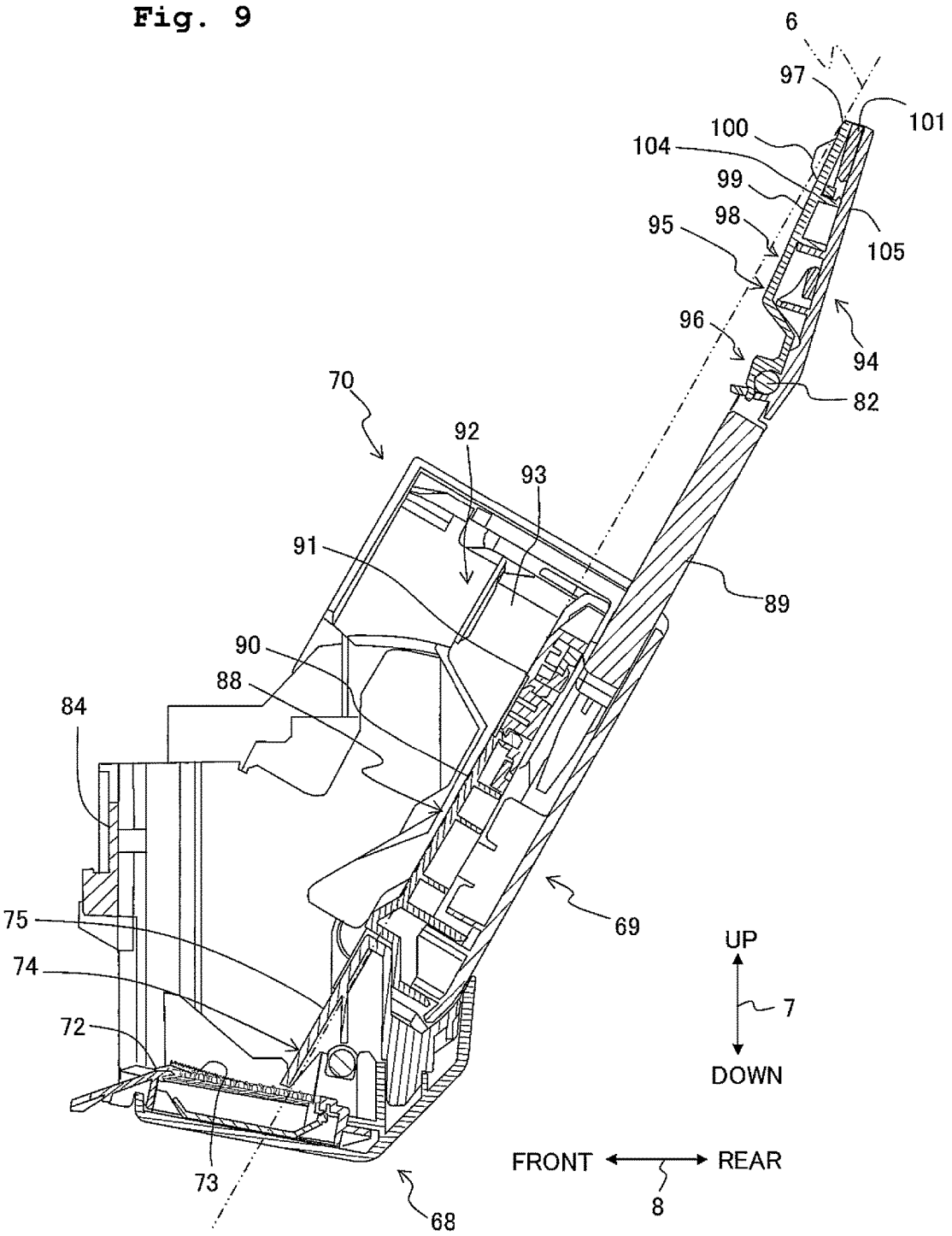
FIG. 9 is a cross-sectional view taken along the line IX-IX of FIG. 8.
Figure 10:
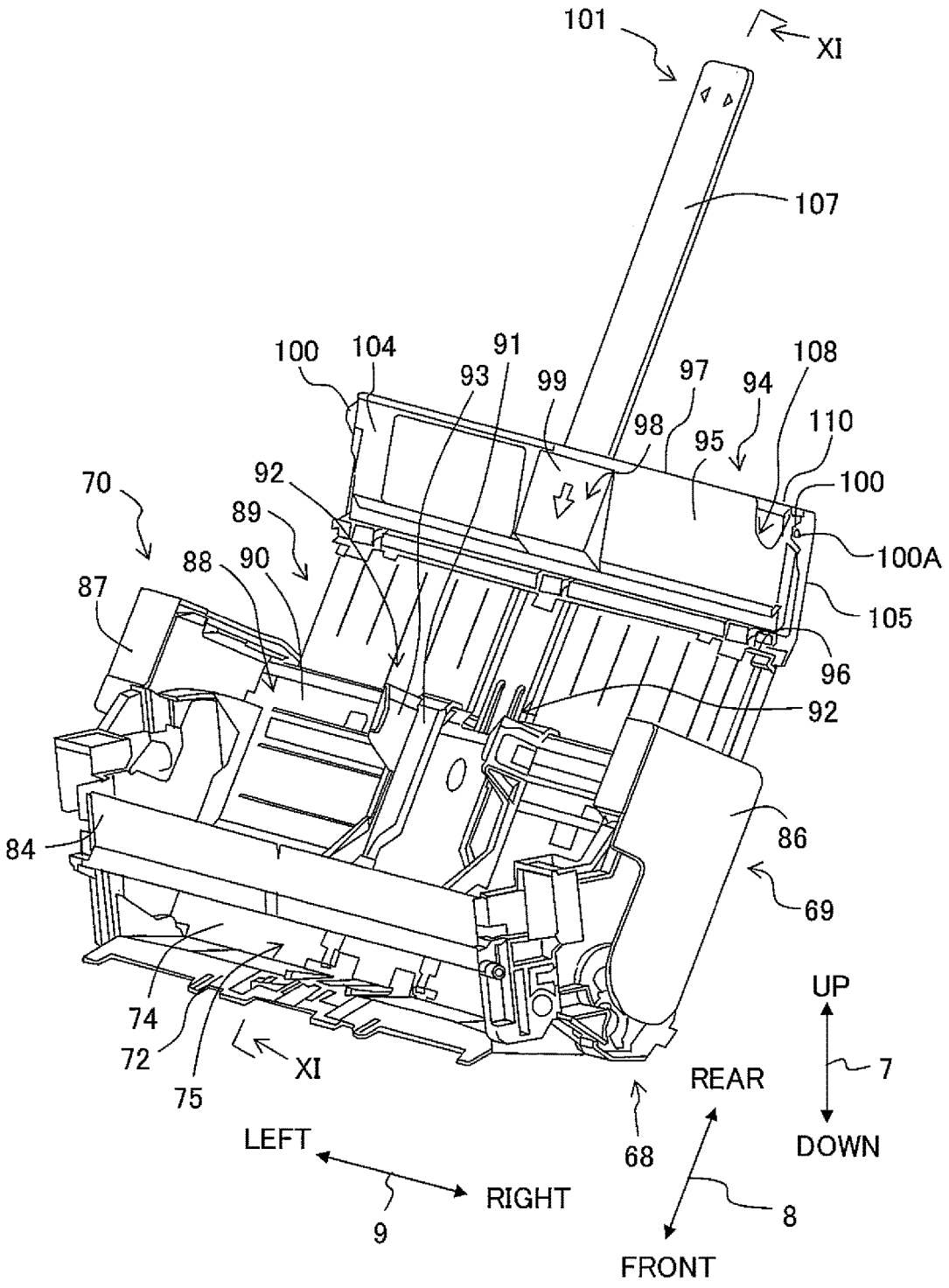
FIG. 10 is a perspective view of the bypass tray 70 in which the movable unit 69 is in the inclined state, the extension member 89 is extended, the tray cover 94 is in the open position, and a support member 101 is in a projecting state.

As depicted in FIGS. 8 and 9, an extension member 89 is provided for the support member 88. The extension member 89 is a flat plate-shaped member and the extension member 89 can be housed in the inner space formed below the support surface 90 of the support member 88. The extension member 89 is slidably movable between a housed state depicted in FIGS. 6 and 7 and an extended state depicted in FIGS. 8 and 9. In the housed state, the extension member 89 is housed in the inner space of the support member 88. In the extended state, the extension member 89 is extended above the support member 88. The housed state corresponds to a fifth position and the extended state corresponds to a sixth position.

A tray cover 94 is provided at the upper end of the extension member 89. The tray cover 94 is provided for the extension member 89 to be rotatable around a shaft 82 (see FIG. 4). The tray cover 94 is a member in a flat plate shape capable of sealing the openings of the bypass tray 70 on the upper end side and covering the space on the side of the support surface 90. The tray cover 94 corresponds to a first plate member.

Figure 6:
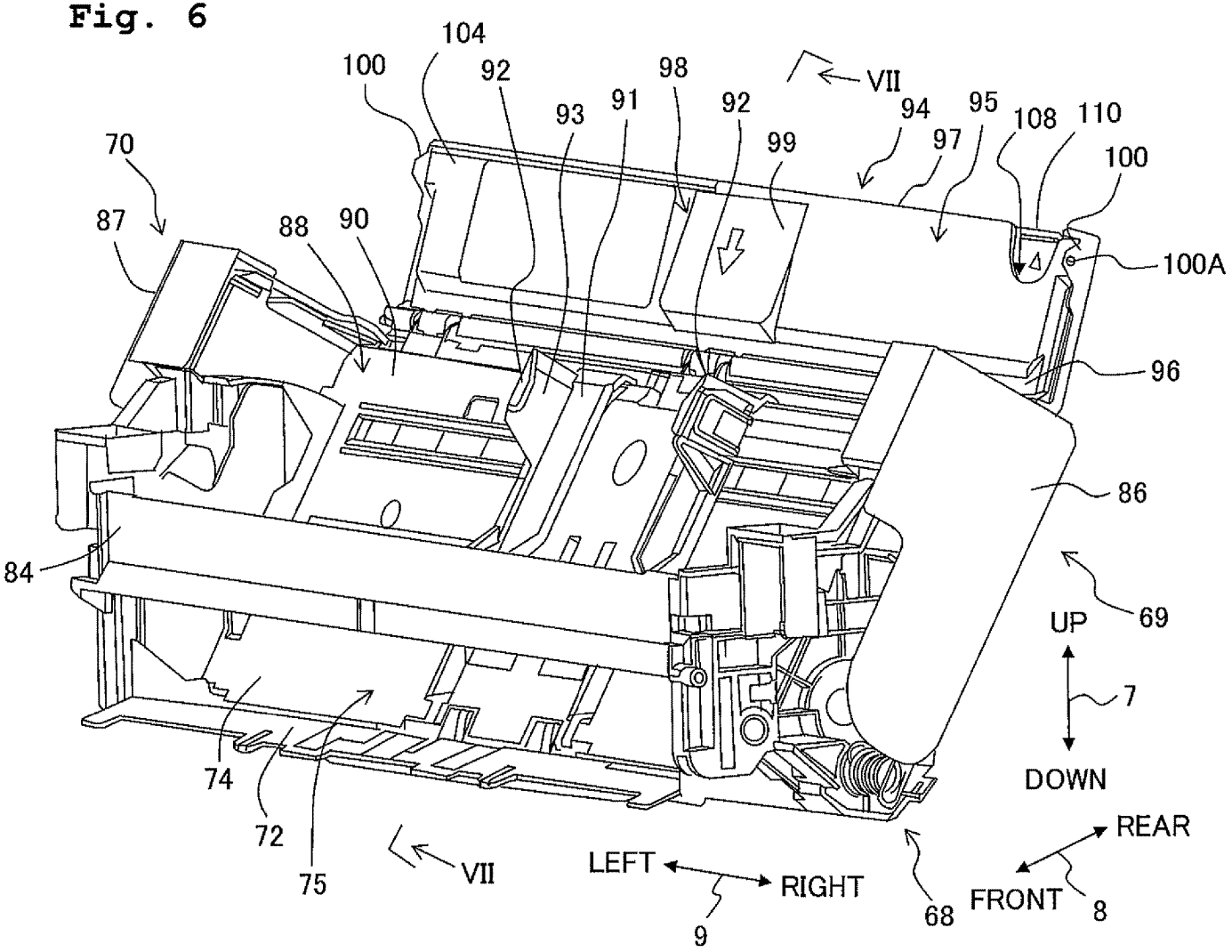
FIG. 6 is a perspective view of the bypass tray 70 in which the movable unit 69 is in the inclined state and the tray cover 94 is in an open position.

As depicted in FIG. 1, in a state that the movable unit 69 is in the upstanding state and the extension member 89 is in the housed state, the tray cover 94 is rotatable to arrive at the position where the openings of the bypass tray 70 on the upper end side are covered with the tray cover 94. Further, as depicted in FIGS. 6 and 7, in a state that the movable unit 69 is in the inclined state and the extension member 89 is in the housed state, the tray cover 94 is rotatable to arrive at the position where the openings of the bypass tray 70 on the upper end side are open. The position where the tray cover 94 makes the openings of the bypass tray 70 on the upper end side open (FIGS. 6 and 7) corresponds to the first position and the position where the openings of the bypass tray 70 on the upper end side are sealed with the tray cover 94 (FIGS. 1, 3 and 4) corresponds to the second position.

In a case that the tray cover 94 is in the position where the upper end side of the bypass tray 70 is open (FIGS. 6 and 7), the tray cover 94 extends obliquely upward to extend the support surface 90, so that the upper end side of the recording sheet protruding from the support surface 90 can be supported by the tray cover 94.

As depicted in FIGS. 6 to 9, an inner surface 95, which faces upward in the up-down direction 7 in the same manner as the support surface 90 when the tray cover 94 is in the open state, is formed of a plurality of surfaces with a curved surface and concavities and convexities. A proximal end 96 of the inner surface 95 is positioned on the side nearer to the placement surface of the multi-function peripheral 10 than a virtual plane 6 (see FIGS. 7 and 9) which includes the support surface 90 when the movable unit 69 is in the inclined state. That is, the proximal end 96 is positioned on the lower side in the up-down direction 7 than the virtual plane 6. The proximal end 96 is arranged close to the lower end side of the tray cover 94 which is the rotation end of the tray cover 94, i.e., close to the support surface 90. The extension member 89 can be housed in the inner space below the support surface 90 of the support member 88 and the tray cover 94 is rotatably connected to the upper end of the extension member 89, and thus the proximal end 96 of the tray cover 94 is positioned below the virtual plane 6.

A distal end 97 of the inner surface 95 of the tray cover 94 is positioned substantially on the virtual plane 6. The distal end 97 is arranged on the upper end side of the tray cover 94 which is the rotation forward end of the tray cover 94, i.e., away from the support surface 90. The distal end 97 extends in the left-right direction 9 and the entire part of the distal end 97 in the left-right direction 9 is substantially positioned on the virtual plane 6. The distal end 97 is substantially positioned on the virtual plane 6 regardless of the slide position of the extension member 89. In this context, a state "substantially positioned on the virtual plane 6" means a state in which the recording sheet is supported by the plurality of surfaces (parts) without being bent or curved even when the plurality of surfaces (parts) are not strictly on the virtual plane 6; in other words, it means a state in which the recording sheet is supported so that separation performance is stably obtained by the separation piece 72.

A convex portion 98 is provided in the distal end 97 of the inner surface 95 of the tray cover 94 at the center in the left-right direction 9. In a case that the tray cover 94 is in the first position, the convex portion 98 projects upward from the inner surface 95. A part (the side of the distal end 97) of an upper surface 99 of the convex portion 98 is substantially positioned on the virtual plane 6. Convex pieces 100 are provided at both ends of the tray cover 94 in the left-right direction 9. Each of the convex pieces 100 has a projection 100A lightly engaged with a predetermined part of the bypass tray 70 to prevent the tray cover 94 in the second position from easily rotating toward the first position. Therefore, in a case that the user rotates the tray cover 94 with respect to the bypass tray 70, the user is capable of having click feeling lightly. Further, the convex pieces 100 are arranged in the tray cover 94 at both ends in the left-right direction 9 on the side of the distal end 97. Thus, in a case that the recording sheet is normally supported by the support surface 90 of the bypass tray 70, the convex pieces 100 do not come into contact with the recording sheet. Accordingly, there are no parts or portions projecting above the virtual plane 6 in the inner surface 95, which is capable of coming into contact with the recording sheet normally supported by the support surface 90 of the bypass tray 70.

As depicted in FIGS. 10 to 13, a support member 101 is provided in the tray cover 94. The support member 101 is an elongated flat plate. The support member 101 is rotatable or swingable between a housed state in which the support member 101 is housed in the tray cover 94 and a projecting state in which the support member 101 projects upward from the distal end 97 of the tray cover 94 in the open state. The support member 101 corresponds to a second plate member. The housed state corresponds to a third position and the projecting state corresponds to a fourth position.

A through hole 102 is formed in the support member 101 on the side of a rotation base end. The through hole 102 is supported by a shaft 103 of the tray cover 94, which makes it possible to rotatably support the support member 101 with respect to the tray cover 94. A rotation support unit is formed of the shaft 103, a cam 106 and an inner surface member 104 which will be described later.

A part of the support member 101 on the side of the rotation base end is formed to have an approximately-semicircular curved surface. A notch 109 is formed in a part of the approximately-semicircular curved surface to follow the circumferential direction. On both ends of the notch 109 in the circumferential direction, end surfaces 110, 111 extending in a radial direction of the through hole 102 are formed. The end surface 110 is allowed to abut against the cam 106 described later on, and thus the rotation position of the support member 101 in the housed state is defined.

A cam follower 112, which projects in a direction of axis of the though hole 102, is provided in the rotation base end having the semicircular shape of the support member 101 at the farthest end in a longitudinal direction. The through hole 102 of support member 101 is inserted through the shaft 103 of an outer surface member 105 in a state that the cam follower 112 projects toward the outer surface member 105.

The tray cover 94 includes the inner surface member 104 constituting the inner surface 95 (proximal end 96, distal end 97, convex portion 98) and the outer surface member 105 positioned on the side opposite to the inner surface 95. In the outer surface member 105, the cylindrical shaft 103 projects toward the inner surface member 104 at a position corresponding to the convex portion 98 of the inner surface member 104. The shaft 103 has flat surfaces in which the upper side and the lower side of the cylindrical shape in the up-down direction 7 are concave inward in the radial direction. The flat surfaces enable the support member 101 to change the posture thereof such that the support member 101 in the projecting state is inclined to the shaft 103 as will be described later. The inner surface member 104 corresponds to a support plate.

The cam 106 is provided around the shaft 103. The cam 106 is a circular arc-shaped rib provided around the shaft 103 and the cam 106 projects toward the inner surface member 104 from the outer surface member 105. In a case that the tray cover 94 is in the first position, the cam 106 is provided to extend from the left side in the left-right direction 9 to the lower side in the up-down direction 7 with respect to the shaft 103. The projecting end of the cam 106 has different positions depending on the position in the circumferential direction with the shaft 103 as the center. That is, the height of projection of the cam 106 from the outer surface member 105 (hereinafter simply referred to as the height of the cam 106) is lowest at a left-side position with respect to the shaft 103 in the left-right direction 9, and the height of the cam 106 is highest at the lower-side position with respect to the shaft 103 in the up-down direction 7. The height of the cam 106 changes smoothly from the position on the left side with respect to the shaft 103 in the left-right direction 9 to the position on the upper side with respect to the shaft 103 in the up-down direction 7. In other words, the upper surface of the cam 106 constitutes an inclined surface, the inclination of which changes smoothly from the position on the left side with respect to the shaft 103 in the left-right direction 9 to the position on the upper side with respect to the shaft 103 in the up-down direction 7. A recess portion 113, which is concave toward the outer surface member 105, is provided in the projecting end of the cam 106 on the lower side in the up-down direction 7. The cam follower 112 can be engaged with the recess portion 113.

The cam follower 112 of the support member 101 can abut against the projecting end of the cam 106 in a state that the shaft 103 of the outer surface member 105 is inserted through the through hole 102 of the support member 101. The support member 101 is allowed to rotate toward the tray cover 94 in the state that the shaft 103 is inserted through the through hole 102, so that the support member 101 is housed between the inner surface member 104 and the outer surface member 105. That is, the support member 101 is in the housed state in which the support member 101 is housed in the tray cover 94. In this housed state, the end surface 110 of the notch 109 of the support member 101 abuts against the cam 106. By allowing the end surface 110 to abut against the cam 106, the rotation position of the support member 101 in the housed state is determined. In this housed state, the inner surface 95 of the inner surface member 104 is parallel to a support surface 107 of the support member 101.

The support surface 107 of the support member 101 faces to the direction which is the same as that of the inner surface 95 of the tray cover 94. In the housed state of the support member 101, the support surface 107 is rarely exposed to the outside of the tray cover 94. A notch 108 is formed in the distal end 97 of the inner surface member 104. A part of the support surface 107 of the support member 101 is exposed to the outside through the notch 108. The support surface 107 corresponds to the third surface.

Figure 13:
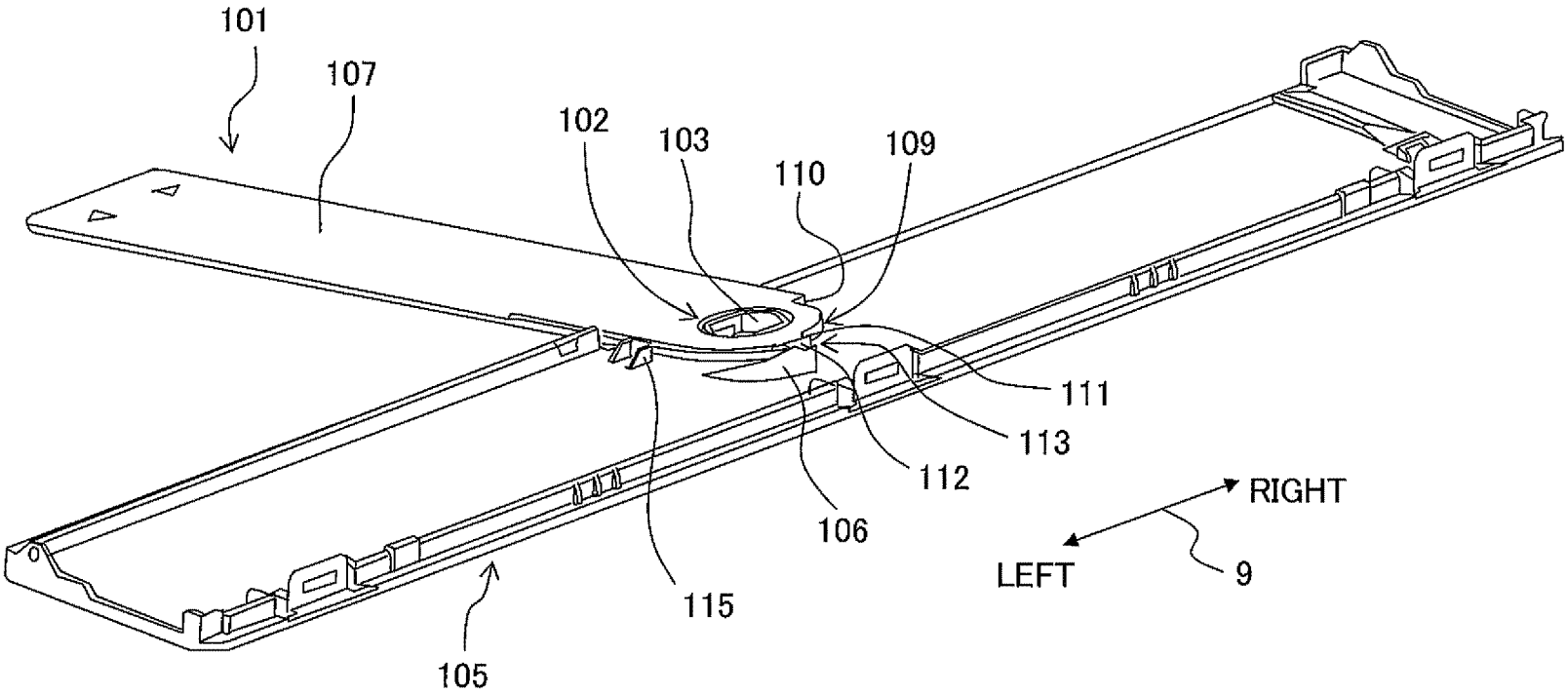
FIG. 13 is a perspective view of the support member 101 in the projecting state and the outer surface member 105.

When the user takes and pulls out the part of the support surface 107 of the support member 101 in a state of being exposed through the notch 108 of the inner surface member 104, the support member 101 is rotated around the shaft 103. In a state that the rotated support member 101 is allowed to fully protrude from the tray cover 94, the cam follower 112 is engaged with the recess portion 113 of the cam 106. By letting the cam follower 112 engage with the recess portion 113 of the cam 106, the rotation position of the support member 101 in the projecting state is defined. As depicted in FIG. 13, a stopper 115 is formed on the outer surface member 105 to prevent the support member 101 from further rotating. The stopper 115 is a rib protruding from the outer surface member 105, and has a substantially square-bracket (']') shape as viewed from above. When the cam follower 112 is engaged with the recess portion 113 of the cam 106, the support member 101 makes a contact with the stopper 115. Therefore, the support member 101 can not rotate any further beyond the stopper 115.

Figure 11:
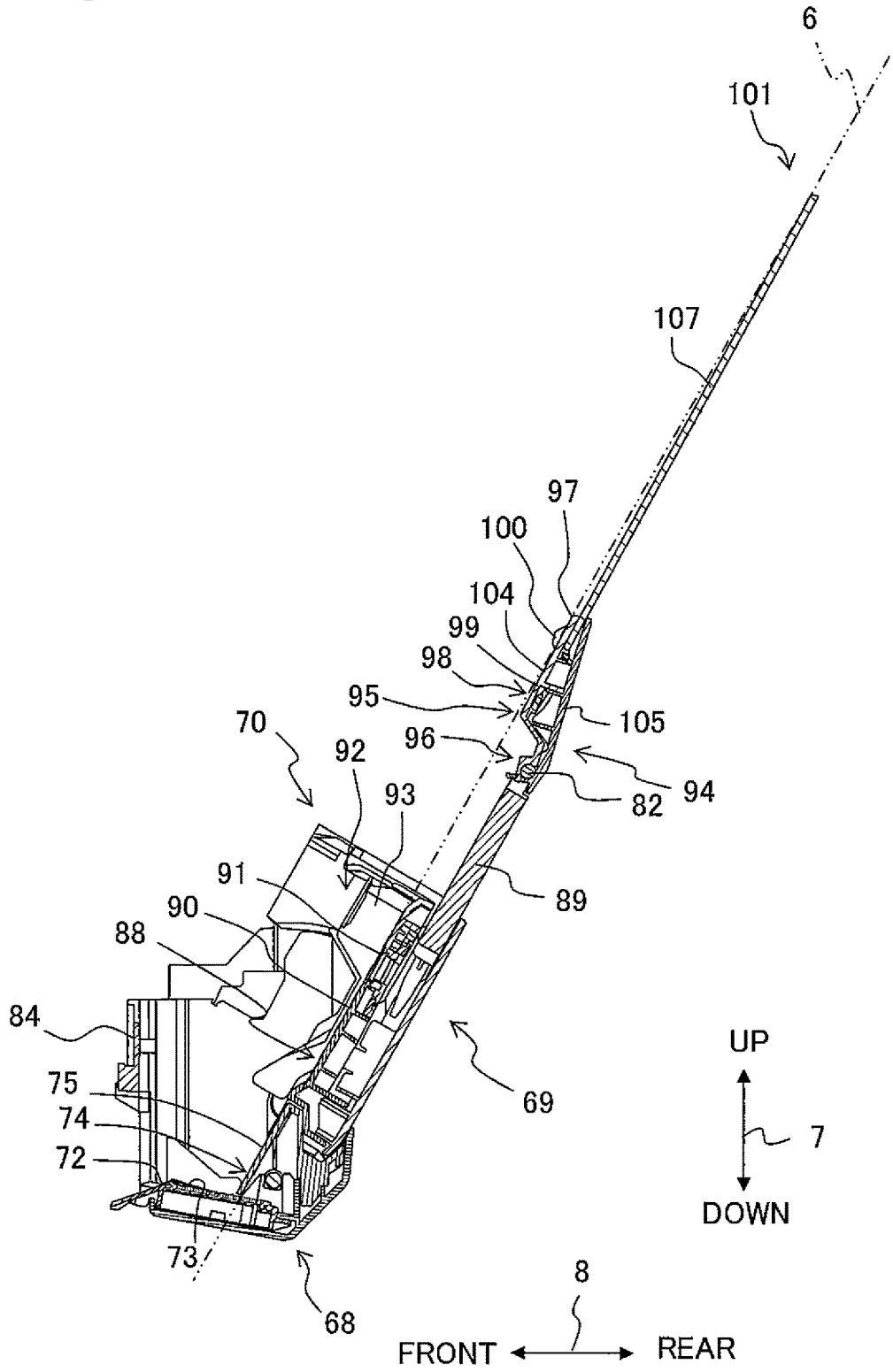
FIG. 11 is a cross-sectional view taken along the line XI-XI of FIG. 10.
Figure 12:
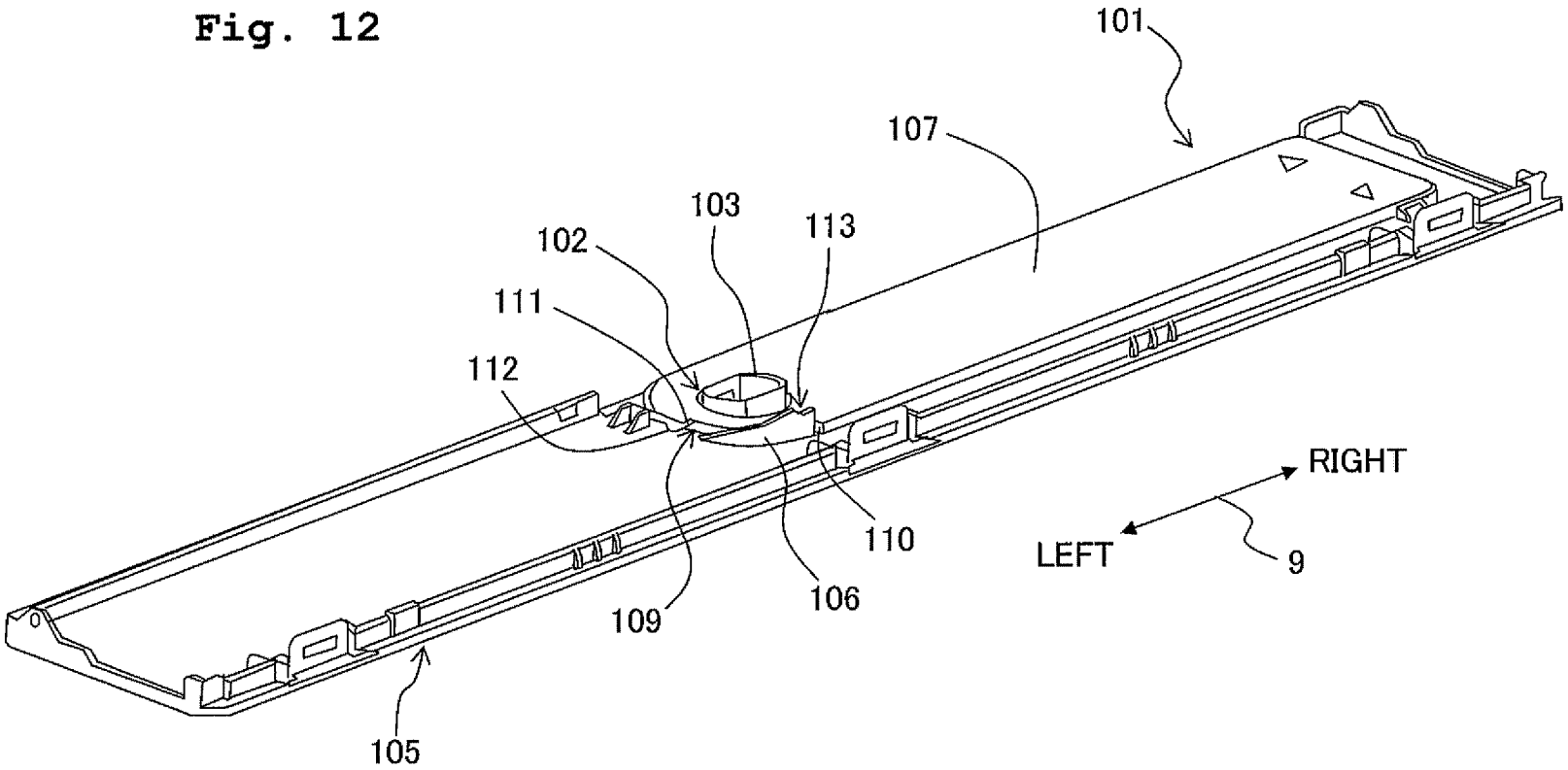
FIG. 12 is a perspective view of the support member 101 in a refracted or housed state and an outer surface member 105.

The rotation of the support member 101 around the shaft 103 moves the cam follower 112 in a state that the cam follower 112 is brought into sliding-contact with the projecting end of the cam 106, thereby changing the posture of the support member 101. In the process in which the support member 101 is rotated from the housed state to the projecting state, the cam follower 102 slidably moves along the projecting end of the cam 106; a part of the support member 101 on the side of the cam follower 112 moves to a position farthest from the outer surface member 105; and a part of the inner circumferential surface of the through hole 102 positioned farthest from the cam follower 112 moves in a direction closer to the outer surface member 105. Accordingly, the posture of the support member 101 is changed so that a part of the support member 101 on the side of rotation forward end protruding upward from the tray cover 94 in the first position moves downward in the up-down direction 7. As depicted in FIG. 11, when the support member 101 is in the housed state, the support surface 107 of the support member 101 (see in FIG. 10) is substantially parallel to the outer surface member 105, but is not parallel to the virtual plane 6. Assuming that the support member 101 is rotated from the housed state to the projecting state with maintaining a state in which the support surface 107 of the support member 101 is substantially parallel to the outer surface member 105, then the support member would be projected upward in the up-down direction 7 with respect to the virtual plane 6. On the other hand, in this embodiment, in the process in which the support member 101 is rotated from the housed state to the projecting state, the cam follower 102 slidably moves along the projecting end of the cam 106, as described above. As depicted in FIG. 13, the cam 106 is configured so that the height of the cam 106 is lowest at a left-side position with respect to the shaft 103 in the left-right direction 9, and that the height of the cam 106 is highest at the lower-side position with respect to the shaft 103 in the up-down direction 7. Therefore, when the support member 101 is rotated from the housed state to the projecting state, the posture of the support member 101 is changed so that the part of the support member 101 on the side of rotation forward end moves downward in the up-down direction 7, in accordance with the height of the cam 106.

The engagement of the cam follower 112 with the recess portion 113 of the cam 106 positions the support member 101 in the projecting state. The support surface 107 of the support member 101 in the projecting state around the through hole 102 is sandwiched between the inner surface member 104 of the tray cover 94 and the cam 106 to be maintained in a posture in which the part of the support member 101 on the rotation forward end is moved downward. As a result, the support surface 107 of the support member 101 in the projecting state is substantially parallel to the virtual plane 6.

<Operation of Printer Unit 11>

In the following, an explanation will be made about the operation of the printer unit 11 as performed when the feed tray 20 and the bypass tray 70 are used respectively.

In a case that the bypass tray 70 is not used, the movable unit 69 is in the upstanding state as depicted in FIG. 1. Thus, the profile or project area of the movable unit 69 as viewed in a plan view is decreased, thereby making it possible to reduce the space of the multi-function peripheral 10 on the back surface side. Further, the tray cover 94 is rotated to the position where the openings at the upper end of the bypass tray 70 are covered with the tray cover 94. If an enough space is provided on the back surface side of the multi-function peripheral 10, the movable unit 69 may be still in the inclined state even when the bypass tray 70 is not used.

When the feed tray 20 is used, the recording sheet having a desired size is set to the feed tray 20. Specifically, a plurality of recording sheets are placed on the feed tray 20 in a state that the recording sheets are stacked. The feed tray 20 on which the recording sheets are placed is allowed to be in an installed state by being inserted into the casing 14 through the opening 13. In this state, the feed roller 25 abuts against the uppermost recording sheet of the plurality of recording sheets placed on the feed tray 20. The printer unit 11 feeds the recording sheet from the feed tray 20 based on the input by the user, the printing data and/or the like.

When the instruction to start the printing is accepted, the printer unit 11 drives the unillustrated motor to rotate the feed roller 25, the first conveyance roller pair 54 and the second conveyance roller pair 55 at predetermined timings. The uppermost recording sheet is fed from the feed tray 20 to the conveyance path 65 in response to the rotation of the feed roller 25. The recording sheet that is fed from the feed tray 20 is guided by the curved passage 65A of the conveyance path 65, and then arrives at the first conveyance roller pair 54. The ink droplets are discharged from the recording head 39 and a desired image is recorded on the recording sheet conveyed to the recording unit 24 by being interposed by the first conveyance roller pair 54. The recording sheet, for which the image recording has been completed, is conveyed through the straight passage 65B by being interposed by the second conveyance roller pair 55, and then the recording sheet is discharged on the discharge tray 21.

In a case that the bypass tray 70 is used, the movable unit 69 is in the inclined state as depicted in FIG. 3. Accordingly, the support surfaces 74, 90 form one flat surface in the bypass tray 70. Further, as depicted in FIG. 6, the tray cover 94 is rotated to the position (first position) where the openings of the bypass tray 70 on the upper end side are open.

As depicted in FIG. 8, the extension member 89 is pulled out as appropriate depending on the size of the recording sheet set in the bypass tray 70. Further, the pair of side guides 92 is moved to the position corresponding to the width of the recording sheet set in the bypass tray 70. The rotation of the tray cover 94 to the open position substantially positions the distal end 97 and the upper surface 99 of the tray cover 94 on the virtual plane 6 including the support surfaces 74, 90.

In a case that the recording sheet, which protrudes upward from the extension member 89 and the tray cover 94, is set in the bypass tray 70 and that the tray cover 94 is in the open position, the support member 101 in the housed state is rotated to be in the projecting state. The support surface 107 of the support member 101 in the projecting state is substantially parallel to the virtual plane 6. The distance (difference in height) between the support surface 107 and the virtual plane 6 corresponds to a thickness of the inner surface member 104 of the tray cover 94. In this context, the phrase "substantially parallel to the virtual plane 6" means as follows. That is, even when a surface is not exactly parallel to the virtual plane 6, the surface is parallel to the virtual plane 6 to the extent that the recording sheet is supported by the surface without being bent or curved; in other words, a surface is parallel to the virtual plane 6 to the extent that the recording sheet is supported so that separation performance is stably obtained by the separation piece 72.

In the case that the bypass tray 70 is used, the recording sheet having a desired size is set in the bypass tray 70. In particular, the recording sheets having a desired size are placed on the support surfaces 74, 90 of the bypass tray 70 in a state that the recording sheets are stacked. The upper ends of the recording sheets placed on the support surfaces 74, 90 are supported also by a part of the upper surface 99 and the distal end 97 of the tray cover 94. Since the support surfaces 74, 90, the distal end 97 and the part of the upper surface 99 are substantially positioned on the same virtual plane 6, the recording sheets placed on the bypass tray 70 are neither bent nor flexed. Further, in a case that the support member 101 is used, the support surface 107 of the support member 101 is substantially parallel to the virtual plane 6, and thus the recording sheets are neither bent nor flexed greatly at the boundary between the distal end 97 of the tray cover 94 and the support member 101.

The feed roller 76 of the bypass tray 70 abuts against the recording sheet disposed on the uppermost side of the recording sheets set in the bypass tray 70. Further, the lower ends of the recording sheets abut against the separation piece 72. The printer unit 11 feeds the recording sheet from the bypass tray 70 based on the input by the user, the printing data and/or the like.

When the instruction to start the printing is accepted, the printer unit 11 drives the unillustrated motor to rotate the feed roller 76, the first conveyance roller pair 54 and the second conveyance roller pair 55 at predetermined timings. The uppermost recording sheet is fed from the bypass tray 70 to the bypass route 66 in response to the rotation of the feed roller 76. The recording sheet fed through the bypass route 66 is further conveyed through the straight passage 65B of the conveyance path 65, and then arrives at the first conveyance roller pair 54. During this process, the outer guide member 18, the back surface cover 22 and the guide member 31, those of which define the bypass route 66 and the straight passage 65B, guide the recording sheet toward the first conveyance roller pair 54. The ink droplets are discharged from the recording head 39 and a desired image is recorded on the recording sheet conveyed to the recording unit 24 by being interposed by the first conveyance roller pair 54. The recording sheet, for which the image recording has been completed, is discharged on the discharge tray 21 by the second conveyance roller pair 55.

Effect of Embodiment

According to this embodiment, the support surfaces 74, 90, the distal end 97 and the part of the upper surface 99 of the bypass tray 70 are substantially positioned on the same virtual plane 6, and thus the recording sheet set in the bypass tray 70 is neither bent nor flexed. Further, since the support surface 107 of the support member 101 is substantially parallel to the virtual plane 6, the recording sheet is neither bent nor flexed at the boundary between the distal end 97 of the tray cover 94 and the support member 101. Accordingly, the recording sheet maintained in a posture along the virtual plane 6 abuts against the separation piece 72, and thus the separation piece 72 can achieve the separation performance stably.

The support member 101 is rotatably supported by the shaft 103 inserted through the through hole 102, the cam 106 provided around the shaft 103, and the inner surface member 104 which sandwiches the support member 101 between itself and the cam 106. Thus, the support member 101 is rotatably supported by a simple structure.

The inner surface member 104 constitutes a part of the distal end 97 of the inner surface 95 of the tray cover 94, which increases the area of the distal end 97 and allows the recording sheet to be stably supported.

The bypass tray 70 includes the fixed unit 68 provided in the casing 14 and the movable unit 69 rotatably provided in the fixed unit 68. Thus, it is possible to reduce an area for installing the multi-function peripheral 10 by rotating the movable unit 69.

The state of the movable unit 69 is changed to the housed state in which the support surface 90 is perpendicular to the placement surface of the multi-function peripheral 10, and thus it is possible to reduce the area for installing the multi-function peripheral 10 efficiently.

In a state that the movable unit 69 is in the housed state, the tray cover 94 can rotate to the position where the tray cover 94 covers a space on the side of the support surface 90. Thus, it is possible to prevent foreign matters, dust and the like from entering the space on the side of the support surface 90 of the bypass tray 70.

The side guides 92 are provided in the bypass tray 70, and thus the position adjustment of the edge of the recording sheet is easily performed in the bypass tray 70.

The feed unit includes the feed roller 76 which rotates while abutting against the recording sheet disposed at the uppermost side of the recording sheets supported by the support surface 90, the distal end 97 and the part of the upper surface 99 of the bypass tray 70. Thus, in the process in which the recording sheet is fed by the feed roller 76, one recording sheet is separated from the recording sheets supported by the support surface 90, the distal end 97 and the upper surface 99 by use of the separation piece 72, and then the one recording sheet is fed to the bypass route 66.

The extension member 89 is provided in the bypass tray 70, and thus the recording sheet having a large size can be supported by the bypass tray 70.

What is claimed is:

1. A sheet conveyance apparatus configured to convey a sheet, comprising:

a casing in which a conveyance path is defined;

a sheet support unit including a first surface inclined to a bottom surface of the casing and configured to support a plurality of sheets stacked thereon;

a separation unit arranged in the sheet support unit on a side of the bottom surface and configured to abut against edges of the sheets supported by the first surface;

a first plate member including:

a second surface on a side opposite to the separation unit and facing in the same direction as the first surface, wherein a proximal end of the second surface close to the first surface is positioned on a side nearer to the bottom surface than a virtual plane which is extended from the first surface so that the proximal end of the second surface is located away from the virtual plane, and a distal end of the second surface far from the first surface is movable between a first position at which the distal end is positioned on the virtual plane and a second position at which the distal end is in a position different from the virtual plane;

a second plate member that is rotatable between a third position where a third surface facing in the same direction as the first surface overlaps with the first plate member and a fourth position where the third surface is exposed to a side of the second surface of the first plate member; and a rotation support unit configured to support the second plate member to let the second plate member take a posture in which the third surface at the third position is parallel to the second surface at the first position and a posture in which the third surface at the fourth position is parallel to the virtual plane at the first position, the rotation support unit including a shaft inserted through a through hole formed in the second plate member, a cam provided around the shaft to be brought into sliding contact with the second plate member, and a support plate provided to face the cam and configured to interpose the second plate member at the fourth position between the support plate and the cam;

another plate member which is located between the sheet support separation unit and the first plate member, the proximal end of the first plate being connected to an end of the another plate member, the another plate member being positioned on a side nearer to the bottom surface than the virtual plane; and a feed unit configured to feed the sheet supported by the first surface and the distal end of the second surface to the conveyance path while slidably moving the sheet with respect to the separation unit, wherein the sheet support unit includes a fixed unit fixed to the casing and a movable unit provided in the fixed unit to be rotatable with respect to the fixed unit; and the first surface is provided in the movable unit.

2. The sheet conveyance apparatus according to claim 1, wherein the movable unit is configured to move to a housed position at which the first surface is perpendicular to the bottom surface.

3. The sheet conveyance apparatus according to claim 2, wherein the first plate member is configured to cover a space on a side of the first surface in a case that the first plate member is in the second position and that the movable unit is in the housed position.

4. The sheet conveyance apparatus according to claim 1, wherein the movable unit includes a side guide configured to guide an edge of the sheet in a conveyance direction of the sheet; and the first surface is provided in the side guide.

5. The sheet conveyance apparatus according to claim 1, wherein the feed unit includes a feed roller configured to rotate while abutting against a sheet disposed on an uppermost side of the sheets supported by the first surface and the second surface.

6. The sheet conveyance apparatus according to claim 1, wherein the support plate is configured to constitute a part of the distal end of the second surface.

7. The sheet conveyance apparatus according to claim 1, wherein the another plate member is configured to move between a fifth position at which the another plate member overlaps with a lower side of the first surface and a sixth position at which the another plate member protrudes from the first surface to a side opposite to the separation unit.

8. An image recording apparatus, comprising:

the sheet conveyance apparatus as defined in claim 1; and a recording unit configured to record an image on a sheet in the conveyance path.

9. A sheet conveyance apparatus configured to convey a sheet, comprising:

a casing in which a conveyance path is defined;

a sheet support unit including a first surface inclined to a bottom surface of the casing and configured to support a plurality of sheets stacked thereon;

a separation unit arranged in the sheet support unit on a side of the bottom surface and configured to abut against edges of the sheets supported by the first surface;

a first plate member including:

a second surface on a side opposite to the separation unit and facing in the same direction as the first surface, wherein a proximal end of the second surface close to the first surface is positioned on a side nearer to the bottom surface than a virtual plane which is extended from the first surface so that the proximal end of the second surface is located away from the virtual plane, and a distal end of the second surface far from the first surface is movable between a first position where the distal end is positioned on the virtual plane and a second position where the distal end is in a position different from the virtual plane;

a second plate member provided in the first plate member to be rotatable between a third position at which a third surface facing in the same direction as the first surface overlaps with the first plate member and a fourth position at which the third surface is exposed to a side of the second surface of the first plate member;

a rotation support unit configured to support the second plate member to let the second plate member take a posture in which the third surface at the third position is parallel to the second surface at the first position and a posture in which the third surface at the fourth position is parallel to the virtual plane at the first position, the rotation support unit including a shaft inserted through a through hole formed in the second plate member, a cam provided around the shaft to be brought into sliding-contact with the second plate member, and a support plate provided to face the cam and configured to interpose the second plate member at the fourth position between the support plate and the cam; and another plate member which is located between the separation unit and the first plate member, the proximal end of the first plate being connected to an end of the another plate member, the another plate member being positioned on a side nearer to the bottom surface than the virtual plane, wherein an angle formed by the second plate member at the third position and the virtual plane is different from an angle formed by the second plate member at the fourth position and the virtual plane;

wherein the sheet support unit includes a fixed unit fixed to the casing and a movable unit provided in the fixed unit to be rotatable with respect to the fixed unit; and the first surface is provided in the movable unit.

10. The sheet conveyance apparatus according to claim 9, wherein the second plate member at the forth position is substantially parallel to the virtual plane.

* * * * *